United States Patent [19]

Caricchio, Jr. et al.

[11] 4,076,599

[45] Feb. 28, 1978

[54] METHOD AND COMPOSITION FOR PLATING PALLADIUM

[75] Inventors: Jerome Joseph Caricchio, Jr., Binghamton; Edward Robert York, Endicott, both of N.Y.

[73] Assignee: International Business Machines Corporation, Armonk, N.Y.

[21] Appl. No.: 717,419

[22] Filed: Aug. 24, 1976

Related U.S. Application Data

[63] Continuation-in-part of Ser. No. 627,493, Oct. 30, 1975, abandoned.

[51] Int. Cl.[2] ..... C25D 3/50

[52] U.S. Cl. ..... 204/47; 204/40

[58] Field of Search ..... 204/47, 43 N, 40

[56] References Cited

U.S. PATENT DOCUMENTS

| | | | |
|---|---|---|---|
| 3,150,065 | 9/1964 | Fatzer | 204/47 |
| 3,637,474 | 1/1972 | Zuntini et al. | 204/47 |
| 3,920,526 | 11/1975 | Caricchio et al. | 204/47 |
| 3,925,170 | 12/1975 | Skomoroski et al. | 204/43 N |
| 3,933,602 | 1/1976 | Henzi et al. | 204/44 |

FOREIGN PATENT DOCUMENTS

| | | | |
|---|---|---|---|
| 254,987 | 4/1970 | U.S.S.R. | 204/47 |

*Primary Examiner*—G. L. Kaplan

*Attorney, Agent, or Firm*—Sughrue, Rothwell, Mion, Zinn and Macpeak

[57] ABSTRACT

This invention relates to the palladium plating of electrical parts, such as frames, pins, connectors and in general various types of electrical contacts. More particularly, this invention relates to a method and composition for high speed electroplating of uniform, bright palladium deposits over a wide operating current density range using a palladosammine chloride plating bath to which sodium sulfite has been added. The method is adapted for rack plating of parts having an irregular shaped configuration as well as those having a uniform configuration.

17 Claims, 2 Drawing Figures

METHOD AND COMPOSITION FOR PLATING PALLADIUM

CROSS-REFERENCE TO RELATED APPLICATION

This application is a continuation-in-part of application Ser. No. 627,493 filed Oct. 30, 1975 entitled "Method and Composition for Plating Palladium", now abandoned.

BACKGROUND OF THE INVENTION

Low-energy circuit contacts must be of low and stable contact resistance and this can be assured only if the contact metal is a good conductor and does not tarnish with time. The noble metals, such as gold, and the metals of the platinum family which have very low chemical reactivity and essentially do not oxidize or form sulfides meet the foregoing requirements.

Due to the cost of the noble metals, low-energy circuit contacts are not made entirely of noble metals but, rather, the noble metal is electrodeposited on a base metal substrate. At times, where needed, a circuit contact will be plated with two or more noble metals and/or metals of the platinum family in sequence, such as gold over a base layer of palladium. These deposits must be essentially pore-free to prevent foreign matter from entering the pores and spreading onto the contact surface. Porous deposits cause films to be formed on the contacts. These films are produced by corrosion products which result either from the tarnishing of the base metal substrate or from direct-couple corrosion between the base and noble metals.

Gold has been widely used for low-energy circuit contacts since it has excellent resistance to chemical attack and is less expensive than any of the platinum metals with the exception of palladium. However, gold is soft and the common electrodeposited gold alloys suitable for use in low-energy circuit contacts have relatively poor resistance to wear. Palladium, because it is less expensive than gold and is a relatively reactive member of the platinum family, can effectively replace gold for some contact applications. Also, palladium wears better than gold. Further, the density of palladium is lower than the density of gold; thus, for equal thickness, the relative expense of the same thickness of metal contact can be decreased by a factor of two. Where an external gold layer is desired, advantages can be obtained by applying a base layer of palladium as a portion of the total thickness.

Printed circuit cards, that is, cards on which printed circuits are formed, have heretofore used palladium in their electrical contacts for connecting to external circuitry. Assignee's U.S. Pat. No. 3,150,065, which issued Sept. 22, 1964, disclosed a method which employs a palladosammine chloride bath for plating palladium on the electrical contacts of a printed circuit board. This patented method is most widely used in the barrel plating of palladium on electrical contacts which have a pin configuration. The bath required no additives and only minor modifications to maintain a level of plating quality suitable to produce a finished pin. Further, commonly assigned U.S. Pat. No. 3,920,526, issued Nov. 18, 1975, discloses a method for electrodeposition of palladium which employs a palladosammine chloride plating bath containing 16 to 32 grams per liter (g/l) palladosammine chloride, 65 to 250 grams per liter ammonium chloride and sufficient aqueous ammonia to maintain the pH of the plating bath at least 8.8.

In today's technology, the printed circuit cards and the modules to which they are connected have become more complex and it has become necessary to palladium plate electrical contacts or connectors, such as frames, flanges, connector pins, spring contacts and the like, which have an irregular shaped configuration. Also, with the increase in volume of usage of such contacts a high speed plating operation is desirable wherein the contacts are processed in rack or strip form. When the plating bath of the above-mentioned U.S. Pat. No. 3,150,065 patent was tried out for this mode of operation, it was found to have some unsatisfactory limitations. In order to maintain the desired operation current density range of 3–30 amps/ft$^2$ and more particularly 15–25 amps/ft$^2$, it was necessary to employ a high concentration of palladium in the bath which resulted in drag out and a waste of palladium. Also, due to the low chloride content, the bath was not sufficiently conductive and ductile for a high speed rack-type of operation. The plating deposits turned out to be dull, multi-shaded and non-uniform which is totally unacceptable for a contact surface finish. In addition, the process of the U.S. Pat. No. 3,920,526 case leads to unacceptable products when used for electrical parts of relatively complex configurations plated at high speed.

U.S. Pat. No. 3,637,474, issued on Jan. 25, 1972 to Zuntini et al. and assigned to the Sel-Rex Corporation, discloses an electroplating bath for the deposition of palladium from a palladium-urea complex one example of which includes sulfite ions derived from sodium sulfite in solution in the bath. However, this process must be carried out at an elevated temperature (50°–55° C) and requires relatively high sulfite ion concentrations in excess of 2000 parts per million. Furthermore, the Zuntini et al. reference apparently has an upper current density of about 10 amps/ft$^2$.

Attempts to utilize the sulfite ion concentrations disclosed by Zuntini et al. in applicants' process resulted in a heavy white precipitate in the bath which caused the plating process to be inoperative for the intended purpose. While the reason for this phenomenon is not known, it became noticeable at sulfite ion concentrations of about 2000 ppm.

Other palladium processes available in the market were also tried out but these resulted in cracked palladium and adhesion problems from high stresses, poor chemical stability of baths and replenisher solutions and poor reproducibility. It became apparent that an improved palladium plating bath solution would have to be developed which would be capable of high speed rack plating of parts and particularly those having an irregular shaped configuration.

SUMMARY OF THE INVENTION

The present invention makes it possible to carry out the desired high speed plating of irregular shaped parts by providing a novel and improved palladosammine chloride bath composition. The improved composition comprises palladosammine chloride, ammonium chloride, alkali metal or ammonium sulfamate, concentrated ammonium hydroxide (27–30% $NH_{3w/w}$) and the additive alkali metal or ammonium sulfite.

In overcoming the shortcomings of prior art palladium baths, and in particular those disclosed in the aforementioned patents, the present bath is characterized by a combination of features, including a relatively low concentration of palladium and a relatively high concentration of chloride. The low concentration of palladium results in reduced drag out and hence, less waste of palladium and also it is easier to maintain in the form of a palladium complex. The high ammonium chloride concentration makes the bath more conductive and ductile, and maintains the palladium in a more soluble complex state. The solubility of the palladium complex is further enhanced by employing a high pH of 8.5 to 9.6, preferably 9.0 -9.5 hydrogen ion concentration. This results in a more uniform deposit and enhances ductility.

Other improvements in the present composition include, (1) the use of alkali metal or ammonium sulfamate, preferably ammonium sulfamate, which is more soluble than ammonium sulfate and is more conductive in the bath, and (2) the inclusion of the additive alkali metal sulfite or ammonium sulfite, preferably sodium sulfite. As the bath ages and is worked hard, the plating develops small, off-colored, dark areas which are characterized as being thinner and more porous than normal plating. The addition of the sulfite additive in small amounts prevents this undesirable phenomena from happening. Sodium sulfite bestows upon the deposit a pleasing uniform, satin-bright appearance and broadens significantly the operating current density range at which these electrodeposits are obtained. This is one feature which makes the process applicable for high speed reel plating, 10 amps/ft$^2$ or higher, and for any general purpose palladium requirement.

It is believed that other compounds related chemically to sulfite will also function as additives. These may include such compounds as the bifulfites, i.e., sodium bisulfite and the metabisulfites, i.e., sodium metabisulfite.

A further advantage of the additive bath is the fact that palladium deposits have excellent adhesion to nickel underplate without the need for any adhesion promotion steps such as a surface activation or a gold strike. Further, a gold overlayer adheres well to the palladium deposit. In addition, plating results are highly repeatable and the additive is stable and controllable without showing any adverse effects upon extended plating use. Other process features are a room temperature bath operation and far lesser presence of sublimed salts, ammonium chloride, depositing on anodes above the solution and surrounding equipment. The latter is a common nuisance factor with operating a standard palladosammine chloride bath.

It is, then, a primary object of the present invention to provide a novel and improved method and composition for plating palladium.

A further object of the present invention is to provide a novel and improved method and composition for high speed electroplating of uniform, bright palladium deposits over a wide operating current density range.

A still further object of the present invention is to provide a novel and improved method and composition for plating palladium which makes use of an improved palladosammine chloride plating bath to which sulfite has been added.

Another object of the present invention is to provide a novel and improved method and composition for plating palladium which makes use of an improved plating bath comprising palladosammine chloride, ammonium chloride, ammonium sulfamate, ammonium hydroxide, and the additive sodium sulfite.

A further object of the present invention is to provide a novel and improved method for high speed rack plating of palladium on parts and more particularly on electrical contacts having an irregular-shaped configuration.

The foregoing and other objects, features and advantages of the invention will be apparent from the following more particular description of a preferred embodiment of the invention as illustrated in the accompanying drawings.

DESCRIPTION OF PREFERRED EMBODIMENT

Figure 2:
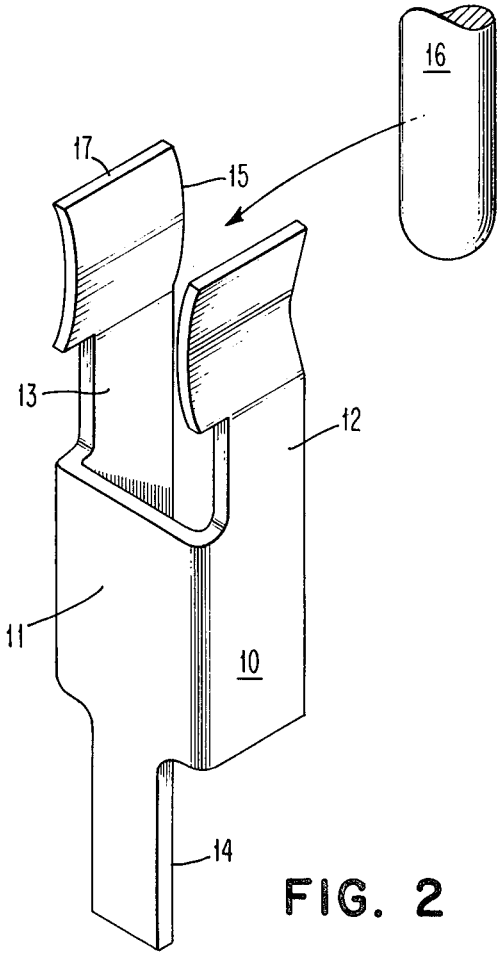
FIG. 2 is an isometric drawing of an electrical connector device which is palladium plated by the method of the present invention.

Referring first to FIG. 2, there is shown a zero or low insertion force, low actuation force electrical connector 10 adapted for incorporation into a printed circuit board, connector housing or the like and suitable for card edge, input/output, array or dual-in-line module applications. The connector comprises a bifurcated spring yoke 11 having a pair of complementary, flat, longitudinally and upwardly extending arms 12 and 13. A mounting post or stem 14 extends downwardly from the lower edge of the central portion or base of yoke 11. The upper extremity of each arm 12, 13 is machine fabricated to provide a cylindrical or barrel-shaped contact surface 15 in opposing and spaced apart relationship at a distance less than the diameter of a male connector pin 16 to be introduced therebetween.

Connector 10 is illustrative of the type of irregular shaped part which heretofore could not be satisfactorily and uniformly palladium plated using prior art plating methods and bath compositions. For example, it was not possible to obtain the same plating deposits on the contact tips 17 and the inner contact surfaces 15. The improved bath composition and large range of current density of the present invention provides the required average current density rate to take care of irregular configurations. High quality deposits of uniform appearance are obtained on the tips as well as on the inner surfaces of the contacts.

Prior to being palladium plated, electrical connector 10 can be run through a conventional nickel plating process. Connector 10 is processed in 12 inch strips containing 110–120 connectors each. Twelve of these strips are mounted into a suitable plastic plating fixture or rack and electrical contact made at one end of each strip with each commoned to a single metal strip at the top of the fixture. The 12 strip rack is processed through a clean line of a hot alkaline cleaner, hot 25% sulfuric acid, persulfate etchant, and a nickel plating bath. Water rinses are included after each operation.

Figure 1:
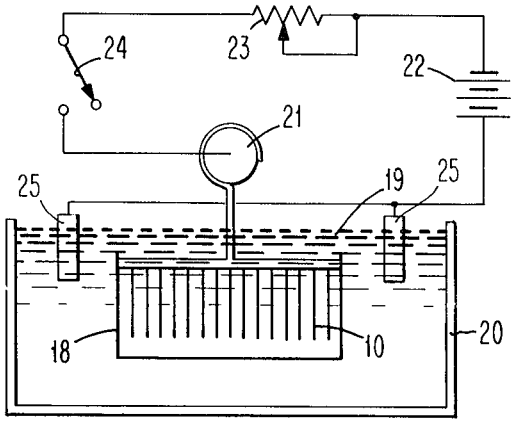
FIG. 1 shows an apparatus for rack plating parts with palladium in accordance with the present invention.

Referring to FIG. 1, after the nickel plating operation the twelve strip rack 18 is immersed in the palladium bath 19 contained in the metal tank 20. The 12 strips of the electrical connectors 10 are suitably fixed to a cathode rod 21 for electrical contact and agitation. The cathode rod 21 and rack 18 are moved back and forth horizontally by suitable motor means, not shown, to supply rack agitation. The palladium bath solution 19 is also agitated by suitable pumping action. An electrical circuit including a battery 22, a variable resistor 23, and a switch 24 is provided to connect the cathode rod 21 to a pair of expanded platinized tantalum anodes 25. The cathode is suspended equidistant between the two anodes and the anodes have a total area which is at least twice that of the cathode. The anodes are in spaced relation with the connector strips 10 in the rack. An operating current density range of 15–25 amps/ft$^2$ is preferred and a current of about 15 amps would be applied for 5–5.5 minutes at a temperature of 75° F to 82° F. As is well known, the electrolysis phenomenon will cause the connectors 10 to be coated with palladium.

After palladium plating, the 12 strip rack is rinsed in hot deionized water, blown off lightly with an air nozzle, and dried in a forced air oven for about 5–10 minutes. The plated strips are removed from the rack, packaged, and the process is repeated.

The bath or solution 19 comprises 20–30 grams/liter of palladosammine chloride, $Pd(NH_3)_2Cl_2$, in an electrolyte comprising 30–60 grams/liter of ammonium chloride, $NH_4$ Cl; 30–40 grams/liter of ammonium sulfamate, $NH_4NH_2SO_3$; 50–100 cc/liter of ammonium hydroxide, $NH_4OH$; and 1–1000 parts/million (ppm) of sulfite ion concentration derived from sodium sulfite, $Na_2SO_3$. The amount of ammonium hydroxide used is that required to maintain a pH in the 9.0–9.5 region. Although the preferred operating current density range is 15–25 amps/ft$^2$, the solution has a wide current density range of 3–30 amps/ft$^2$. This feature is necessary to make high volume strip plating of irregular shaped parts or substrates both workable and economical. It is to be noted that because of the specific composition of the present bath, the wide current density range of 3–30 amps/ft$^2$ is obtained without the necessity of increasing the palladium content of the bath. Also, due to the increased conductivity and higher concentration of complexing agents in the bath, the palladium plated via the present method has all the indications of good ductility. No cracking of the plating due to high stress is observed in cross-sections and adhesion to the nickel subplate is excellent without any of the usual nickel activation required.

Porosity of palladium deposits plated by the present bath composition was determined by electrographic gel tests and a deposit of 2.0–3.0 microns gave no porosity in the critical contact area 15 of the connector 10.

Although the disclosed embodiment of the invention shows the use of the bath composition in a rack plating operation, it will be understood that it can be used equally as well in barrel plating and more important, in high speed continuous strip plating.

The following description is a specific embodiment of the present invention. Spring connectors of the configuration of FIG. 2 of the drawing are to be palladium plated in the apparatus of FIG. 1 of the drawing. The connectors are formed of a beryllium copper alloy. Twelve ½ inch strips are processed in a rack, as illustrated in FIG. 1.

The initial steps in the process are to thoroughly clean the connectors. First, anodic cleaning in a suitable apparatus containing hot alkaline solution is carried out at a potential of 4 ± 0.2 volts direct current. maintained Pennsalt K-2 cleaner available from the Pennwalt Corporation is used at a concentration of 8 to 12 ounces per gallon of deionized water. The alkaline cleaning bath is maintained at 150°–160° C, with agitation of the solution by means of solution pumping. Thereafter, following rinsing to be certain all oily coatings are removed from the connectors, a hot sulfuric acid dip is carried out. The dip bath contains one part concentrated sulfuric acid per three parts deionized water, for about 25% concentrated sulfuric acid solution. The sulfuric acid bath is maintined at about 120° to 140° F, with periodic manual rack agitation during about a 5 minute treatment time. Following another rinse in deionized water (the first two rinses are carried out for about 1 minute with constant manual rack agitation for the first 15 seconds), the connectors are prepared for nickel plating by preliminary treatment in an etching bath. The etching bath used contained about 3 lbs. sodium persulfate and about 1½ fluid ounces sulfuric acid per gallon deionized water. The rack containing the connectors is maintained in the etchant, held at about 70° to 80° F, for about 1 minute with periodic manual rack agitation. A deionized water rinse similar to that discussed above, is carried out prior to nickel plating.

Nickel plating is conducted in an apparatus as illustrated by FIG. 1 of the drawing. Conventional nickel plating baths can be employed. The bath used in this example was a nickel sulfamate bath of the following formulation:

Nickel sulfamate sufficient to provide about 9.5–11 ounces of nickel metal per gallon,
about 4.5 to 6.0 ounces of boric acid per gallon
pH is maintained at about 3.0 to 4.2 by addition of sulfamic acid to lower pH or nickel carbonate to raise pH, when necessary.

Plating is carried out with a bath temperature of 120° to 130° F, at about 9.5 amps for about 9 to 10 minutes. A uniform nickel coating of about 1 to 3 microns thickness results. A deionized water rinse is carried out as disclosed above.

The connectors are then palladium plated, again using a plating bath apparatus as shown in FIG. 1 of the drawing.

The palladium plating bath contains about 21 to 27 g/l of palladosammine chloride, about 40–45 g/l of ammonium chloride, sufficient to provide about 30 to 35 g/l of chloride ion ($NH_4Cl$ is approximately 66% Cl), about 31 to 33 g/l ammonium sulfamate and sufficient ammonium hydroxide (generally about 125 to 135 milliliters per gallon) to maintain the pH of the bath at about 9.10 to 9.40. During the use of the palladium plating bath, sodium sulfite is added to yield a sulfite ion concentration of about 2 to 200 ppm. The exact amount of sulfite used is determined by visually observing the appearance of the palladium deposit. Through experience, the process engineer will lower or increase sulfite content to maintain uniformity of deposit. With the bath held at about 72° to 82° F, plating is carried out under a current of about 14.5 to 15.5 amperes for about 5 to 5.5 minutes. During the palladium plating, the rack is agitated through horizontal reciprocation of the cathode rack head. In addition, the plating solution is agitated through a pumping action. A uniform palladium coating of about 3 microns thickness results.

In this described process, careful rinsing and drying complete the operation. The rack is first rinsed in stagnant water for about 25 to 40 seconds with periodic rack agitation, then the rack is rinsed in deionized water for at least 2 minutes with constant rack agitation for the first 15 seconds; and finally, a last rinse is carried out in hot deionized water at about 160° to 180° F, for about 25 to 35 seconds. Following the blowing off of excess rinse water using clean, filtered, oil-free compressed air, the rack is dried in a forced air oven at about 225° to 245° F. At least 5 minutes drying time is needed. The strips with associated connectors are then removed from the rack and packaged.

As disclosed hereinabove, at times it is desirable to apply a gold overcoat to palladium plated electrical parts. To illustrate this, electrical parts such as low energy module frames are first palladium coated using essentially the sequence discussed above through the drying steps. Thereafter, the frames are suitably annealed to improve the adhesion of the palladium to the substrate prior to plating gold thereon. Following annealing, a sequence of cleansing steps should be carried out using distilled water, surfactant cleaning solution and even mild acid (say 30% HCl at room temperature). Thereafter, gold plating can be carried out using conventional commercial practices.

While the invention has been particularly shown and described with reference to a preferred embodiment thereof, it will be understood by those skilled in the art that various changes in form and details may be made therein without departing from the spirit and scope of the invention.

What is claimed is:

1. A method for depositing palladium on a substrate by electrolysis comprising the steps of:

subjecting an anode to an aqueous bath solution having a pH of about 8.5 to 9.6 and consisting essentially of 20–30 grams/liter of pallados-ammine chloride, 30–60 grams/liter of ammonium chloride, 30–40 grams/liter of ammonium sulfamate, 50–100 cc/liter of concentrated ammonium hydroxide, to maintain the pH of the bath at about a pH of 8.5 to 9.6, and 1–1000 parts/million of a sulfite ion concentration derived from an alkali metal sulfite or ammonium sulfite;

immersing the substrate to be coated as a cathode in said solution and in spaced relation to said anode;

applying a potential difference between said anode and said substrate to obtain a current density of 3–30 amps/ft$^2$ at the cathode;

agitating both said solution and substrate; and maintaining said solution at a temperature of about 72° to 82° F.

2. The method set forth in claim 1 wherein there is maintained a pH in the 9.0–9.5 region.

3. The method set forth in claim 1 wherein the bath solution contains 3–1000 parts/million of sulfite ion concentration.

4. The method set forth in claim 1 wherein the bath consists of said palladosammine chloride, ammonium chloride, ammonium sulfamate, ammonium hydroxide and sodium sulfite.

5. The method of claim 1 wherein said substrate is formed of beryllium-copper alloy.

6. The method of claim 1 wherein said substrate is nickel plated prior to being palladium plated.

7. The method of claim 1 wherein the bath consists of 21 to 27 g/l palladosammine chloride, 40–45 g/l of ammonium chloride, 31 to 33 g/l of ammonium sulfamate, sufficient concentrated ammonium hydroxide to maintain a pH of about 9.10 to 9.40 and 2 to 200 parts/million of sodium sulfite.

8. A method for depositing palladium on a substrate by electrolysis comprising the steps of:

subjecting an anode to an aqueous bath solution having a pH of about 9.0 to 9.4 and consisting essentially of 20–30 grams/liter of pallados-ammine chloride, 30–60 grams/liter of ammonium chloride, 30–40 grams/liter of ammonium sulfamate, 50–100 cc/liter of concentrated ammonium hydroxide, to maintain the pH of the bath at about a pH of 9.0 to 9.4, and 1–1000 parts/million of a sulfite ion concentration derived from an alkali metal sulfite or ammonium sulfite;

immersing the substrate to be coated as a cathode in said solution and in spaced relation to said anode;

applying a potential difference between said anode and said substrate to obtain a current density of 15–25 amps/ft$^2$ for 4–5.5 minutes at the cathode;

agitating both said solution and substrate; and maintaining said solution at a temperature of about 72° to 82°F.

9. The method set forth in claim 8 wherein the bath solution contains 3–1000 parts/million of a sulfite ion concentration derived from sodium sulfite.

10. The method set forth in claim 8 wherein the bath consists of said palladosammine chloride, ammonium chloride, ammonium chloride, ammonium sulfamate, ammonium hydroxide and sodium sulfite.

11. The method of claim 8 wherein said substrate is formed of beryllium-copper alloy.

12. The method of claim 8 wherein said substrate is nickel plated prior to being palladium plated.

13. The method of claim 8 wherein the bath consists of 21 to 27 g/l palladosammine chloride, 40–45 g/l of ammonium chloride, 31 to 33 g/l of ammonium sulfamate, sufficient concentrated ammonium hydroxide to maintain a pH of about 9.10 to 9.40 and 2 to 200 parts/million of sodium sulfite.

14. An aqueous bath solution for the electro-plating of palladium consisting essentially of:

20–30 grams/liter of palladosamine chloride;

30–60 grams/liter of ammonium chloride;

30–40 grams/liter of ammonium sulfamate;

50–100 cc/liter of concentrated ammonium hydroxide so that said bath has a pH of about 8.5 to 9.6; and 1–1000 parts/million of a sulfite ion concentration derived from an alkali metal sulfite.

15. The bath solution as set forth in claim 14 and having a pH of 9.0–9.4.

16. The bath solution as set forth in claim 14 wherein the sulfite ion concentration is 3–1000 parts/million.

17. The bath solution of claim 14 consisting of said palladosammine chloride, ammonium chloride, ammonium sulfamate, ammonium hydroxide and sodium sulfite.

* * * * *

UNITED STATES PATENT AND TRADEMARK OFFICE

CERTIFICATE OF CORRECTION

PATENT NO. : 4,076,599

DATED : February 28, 1978

INVENTOR(S) : Jerome Joseph CARICCHIO, Jr., et al

It is certified that error appears in the above-identified patent and that said Letters Patent are hereby corrected as shown below:

Column 1, line 42 - delete "reactive" insert -- unreactive --

Column 1, line 56 - delete "disclose" insert -- discloses --

Column 3, line 33 - delete "bifulfites" insert -- bisulfites --

Column 5, line 61 - delete "maintained"

Column 8, line 29 - delete "ammonium chloride," (second occurrence)

Column 8, line 43 - delete "palladosamine" insert -- palladosammine --

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*